United States Patent [19]

Borrelli et al.

[11] 4,269,934

[45] May 26, 1981

[54] TIN OXIDE, CADMIUM CHLORIDE DOPED SILVER CHLORIDE ELECTRON BEAM RECORDING MEDIUM

[75] Inventors: Nicholas F. Borrelli, Elmira; Peter L. Young, Painted Post, both of N.Y.

[73] Assignee: Corning Glass Works, Corning, N.Y.

[21] Appl. No.: 86,829

[22] Filed: Oct. 22, 1979

[51] Int. Cl.[3] ..... G03C 1/72; G03C 1/733

[52] U.S. Cl. ..... 430/296; 430/270; 430/567; 430/5; 346/158; 365/118; 365/127; 365/128

[58] Field of Search ..... 430/5, 6, 296, 567, 430/270; 346/158; 365/118, 127, 128

[56] References Cited

U.S. PATENT DOCUMENTS

| | | | |
|---|---|---|---|
| 3,219,448 | 11/1965 | Lu Valle et al. | 96/61 |
| 3,664,837 | 5/1972 | Stanley | 96/38.3 |
| 3,852,771 | 12/1974 | Ross | 430/296 |

OTHER PUBLICATIONS

Def. Pub., T966,003, Maskasky, 1/3/78.

Photo. Sci. Eng., 11(5), pp. 322–328 (1967), Shepp et al.

Marcus et al., "The Use of Silver Halide Emulsion as a Resist," Internal, Electron Devices Meeting, Wash., D.C. (1978).

Bowden, CRC Critical Reviews in the Solid State Sciences, pp. 223–264, (2/1979).

*Primary Examiner*—John D. Welsh

*Attorney, Agent, or Firm*—Kees van der Sterre; Clinton S. Janes, Jr.

[57] ABSTRACT

Electron beam-sensitive films containing silver chloride, cadmium chloride and tin oxide, and the use of such films to provide optical masks by selective film darkening with an electron beam, are described.

10 Claims, 1 Drawing Figure

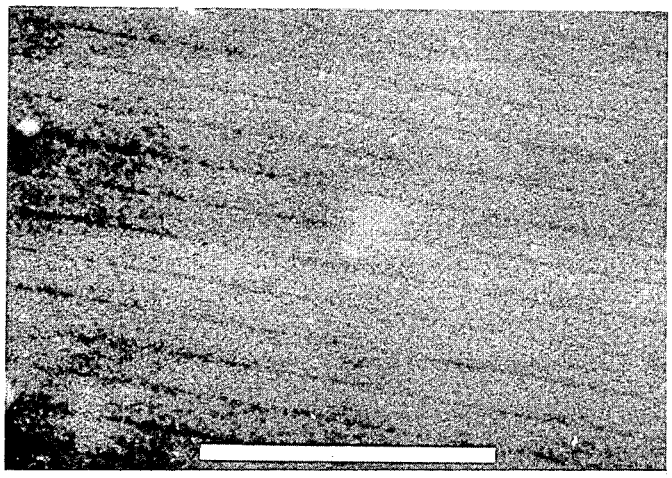

TIN OXIDE, CADMIUM CHLORIDE DOPED SILVER CHLORIDE ELECTRON BEAM RECORDING MEDIUM

BACKGROUND OF THE INVENTION

The present invention is in the field of electron beam recording, and particularly relates to a silver halide-based electron beam writing medium generally useful for storing information and particularly useful for storing patterns which can provide optical masks for microcircuit fabrication or the like. The films incorporated in the present media are related in composition to the films described in our concurrently filed co-pending patent application, Ser. No. 86,690, disclosing ultraviolet light-sensitive films for optical information storage media.

The use of evaporated silver halide films as photographic media is well known. A recent review of the patent literature in this field is provided by U.S. Defensive Publication T966,003 by J. E. Maskasky, dated Jan. 3, 1978. U.S. Pat. No. 3,219,448 is typical of such literature, describing the vacuum deposition of a silver halide film on a substrate such as glass, the exposure of the film to light to provide a latent image therein, and the development of that latent image by chemical means to provide a visible image in the film.

The use of evaporated layers of silver halide or other metallic photosensitive compounds as recording media for images produced by electron beam exposure has received more recent attention. U.S. Pat. No. 3,664,837 to Stanley suggests the use of such layers to provide conductor lines on microcircuit chips, while the article "Evaporated Silver Bromide as an Electron Beam Recording Material" by A. Shepp et al. in *Photographic Science and Engineering*, 11, (5), pp. 322–328 (1967) discusses the various factors governing the behavior of such films during electron bombardment and subsequent development.

Generally, films such as described in the foregoing publications are used in the photographic mode, which means that a chemical development step is required to develop the latent image formed in the film on light or electron beam exposure, in order to provide a silver image with useful optical density. An electron beam storage medium which could provide a visible image when used in a direct writing mode, meaning a mode wherein the image would be produced by electron bombardment without any requirement for chemical development, would be highly desirable.

Photographic films of the kind above described typically exhibit relatively limited resolution when used for electron beam information storage. For applications such as microcircuit masking, image resolution on the order of about 1 micron (1000 lines/mm) or less are required for very large scale integrated circuit manufacture. The electron-beam-written films reported by Stanley and Shepp et al. above reportedly provide resolutions in the 200–300 lines/mm range.

At present, high resolution optical masks for microcircuit fabrication are made using glass-supported chromium film mask blanks by applying a layer of an organic electron-beam-writable photoresist over the chromium film, writing a masking pattern onto the resist with an electron beam, "developing" the selectively exposed resist by removing the exposed (or unexposed) portions thereof, and then chemically removing the physically exposed regions of the chromium film to provide the final optical masking pattern therein. A discussion of the behavior and use of polymeric resists in microcircuit fabrication is provided by M. J. Bowden in "Electron Irradiation of Polymers and Applications to Resists for E-Beam Lithography", *CRC Critical Reviews in the Solid State Sciences*, pp. 223–264 (February 1979). The use of silver halide emulsions as resists has recently been described by R. B. Marcus et al. in the Technical Digest of the IEEE International Election Devices Meeting (December 1978) pages 591–593.

While optical microcircuit masks provided in accordance with procedures such as above described can provide sufficient resolution for present commercial microcircuit products, the large number of processing steps required for the production of such masks is clearly undesirable. A medium into which a high resolution masking pattern of useful optical density could be directly written without any requirement for chemical development would offer a distinct processing advantage.

It is accordingly a principal object of the present invention to provide a medium suitable for electron beam recording which does not require a development step for the production of a visible image, and which exhibits high resolution at presently attainable writing energy levels.

It is a further object of the invention to provide a method for making an optical mask, useful for microcircuit fabrication or the like, wherein an electron beam recording medium of enhanced sensitivity is directly darkened by selective exposure to an electron beam to provide a masking pattern of useful optical density and high resolution.

Other objects and advantages of the invention will become apparent from the following description thereof.

SUMMARY OF THE INVENTION

The present invention is founded upon the discovery of a family of silver chloride-based materials which are sufficiently sensitive to electron beam exposure that a visible darkened image can be produced therein simply by a short exposure to an electron beam of appropriate energy and current density. These materials are broadly characterized as combinations of cadmium chloride-doped silver chloride and tin oxide, typically mixtures of tin oxide and doped silver chloride although other combinations such as alternating layer structures may also exhibit good electron beam sensitivity.

In one aspect, the invention comprises an electron beam recording medium comprising a supported polycrystalline film containing the aforementioned combination of cadmium chloride-doped silver chloride and tin oxide. Typically, the polycrystalline film will contain AgCl and $CdCl_2$ in a weight ratio $AgCl/CdCl_2$ of between 4 and 24. Tin oxide will be present in the film in a proportion sufficient to provide a $AgCl/SnO_x$ weight ratio of between 5 and 60, with x having a value between 1 and 2.

In another aspect, the invention comprises a method for making an optical mask, suitable for microcircuit fabrication or the like, which comprises the step of selectively darkening portions of an electron-beam-sensitive film such as above described. Darkening is accomplished simply by exposing portions of the film to an electron beam for a time sufficient to obtain a contrast ratio of at least about 3 between the darkened and undarkened portions of the film. A mask pattern produced by selective darkening in this manner can be directly used as an optical mask by using it to selectively control the exposure of a photoresist layer on a silicon microcircuit wafer or other substrate to visible light.

Advantages of optical mask fabrication in accordance with the invention include a simplified mask-making procedure and sub-micron feature writing capability. The disclosed films are sufficiently sensitive that writing may be accomplished at electron exposure doses below $10^{-3}$ coulombs/cm$^2$. Nevertheless the resulting masks are relatively stable under ambient lighting conditions, being almost totally insensitive to light of a wavelength greater than 400 nm.

DESCRIPTION OF THE DRAWING

The drawing consists of an electron photomicrograph of an electron beam recording film provided according to the invention into which dark parallel lines have been written by electron beam exposure.

DETAILED DESCRIPTION

For the purpose of the present description an optical mask refers to a mask which can be used at visible and/or near-visible (e.g., ultraviolet) light wavelengths, being effective to at least partially shield a selected substrate against exposure to light of such wavelengths when interposed between the substrate and the light source. The exposure of films produced as herein described to an electron beam of appropriate intensity is thought to result in the formation of at least some metallic silver in the film which acts to reduce the transparency of the film to both visible and ultraviolet light. Thus the resulting darkened regions can act as effective masking regions in both visible and ultraviolet-based lithographic printing systems.

The method of choice for producing polycrystalline films for use in the invention is that of vacuum deposition, preferably by thermal evaporation, although other techniques, such as the deposition of the tin oxide film component by ion beam sputtering, could alternatively be employed. In the case of thermal evaporation, deposition chamber pressures typically range from about $10^{-5}$ to $10^{-6}$ torr. The material employed as a film substrate in accordance with the invention is not critical, and can comprise any rigid or flexible glass or plastic material in sheet form which is or can be made sufficiently inert to the film forming materials so that the substrate will not interact with the film during deposition or use in a manner which affects the sensitivity or optical properties thereof. Preferably, however, the substrate is a flat transparent glass sheet.

The source of the silver and cadmium chloride and tin oxide constituents incorporated in the deposited film is not critical; chemically pure AgCl, $CdCl_2$ and $SnO_2$ constitute suitable starting materials for deposition by thermal evaporation. The use, in an evaporation boat, of a physical mixture of AgCl and $CdCl_2$, wherein $CdCl_2$ constitutes approximately 4–20% by weight and AgCl the remainder, is a useful method for obtaining a vapor-deposited mixture of these compounds.

Although $SnO_2$ is the preferred starting material for incorporating evaporated tin oxide into these films, some reduction of tin probably takes place in the course of evaporation and deposition, reducing the oxygen concentration in the deposited oxide. This is thought to occur even under our preferred deposition procedure wherein slight oxygen partial pressure (e.g., $3\times10^{-5}$ torr of $O_2$) is maintained in the deposition chamber. Nevertheless, while the final oxygen concentration has not been exactly determined, it is believed that there are between 1 and 2 atoms of oxygen for each atom of tin in the final film product.

Preferred film structures within the scope of the invention are those wherein the tin oxide and cadmium-doped silver chloride are concurrently deposited on the substrate, as by simultaneous evaporation, so that the film comprises a mixture of the oxide and the chlorides. It is also possible to sequentially deposit cadmium-doped silver chloride and tin oxide, for example, in alternating thin layers, although somewhat reduced electron beam sensitivity may result from this procedure.

The deposition rates used in film formation are not critical. However, we have found that simultaneous deposition employing growth rates of about 0.3–1.2 Å/second for the tin oxide component and 6–10 Å/second for the $CdCl_2$/AgCl component provide satisfactory results.

Preferred thickness values for evaporated films such as described are in the range of about 0.1–2 microns, although thicker films can also be used. The exact thickness will depend upon the contrast ratio and resolution required for a particular film application. As is conventional, contrast ratios in these films are defined as the ratio of darkened film optical density to undarkened film optical density. Contrast may be enhanced at the expense of resolution by employing thicker films, if desired.

The invention may be further illustrated by reference to the following illustrative example.

EXAMPLE

A flat substrate consisting of a transparent glass slide is thoroughly cleaned and placed in a vacuum chamber. The slide is positioned over a pair of independently heatable tungsten evaporation boats, one boat containing $SnO_2$ and the other a mixture of AgCl and $CdCl_2$ consisting of about 10% $CdCl_2$ and the remainder AgCl by weight. The slide-to-evaporation boat spacing is about 30 centimeters.

The vacuum chamber is evacuated to a pressure of about $10^{-6}$ torr, and then back-filled with oxygen to a pressure of $3\times10^{-5}$ torr. The evaporation boats are then heated to cause the vaporization of their contents, the $SnO_2$-containing boat being heated to a temperature sufficient to cause a tin oxide film growth of about 0.5 Å/second on the substrate, and the boat containing the chloride mixture to a temperature sufficient to cause a $CdCl_2$/AgCl film growth of about 8 Å/second on the substrate. The evaporation of these compounds is continued until a composite film having a thickness of about 1.4 microns has been obtained. The boats are then cooled and the slide and film are removed from the vacuum chamber.

The film thus produced is colorless and transparent in appearance. To test the electron beam writing characteristics of this film, the film and substrate are positioned in a second vacuum chamber and exposed to a scanning electron beam at a beam energy of 20 kv, a beam current of $10^{-10}$ amp., and a spot diameter of about 2000 Å. The scanning pattern is a series of parallel lines having a line spacing of 1.25 microns, the beam scanning rate being about 125 microns/second. The calculated exposure dose under these conditions is computed at about $4\times10^{-4}$ coulombs/cm$^2$.

The film and substrate are removed from the vacuum chamber after electron beam scanning and examined under an optical microscope. The scanning pattern is visible as a series of dark parallel lines, although line resolution cannot be accurately determined by this optical examination. The optical contrast ratio between the dark lines and background is estimated to be more than 3.

For the purpose of facilitating further microscopic examination of this exposed film, the film is lightly etched in dilute aqueous $NH_4OH$ for an etching interval of a few seconds. The etching rate for the unexposed film in dilute $NH_4OH$ is faster than that of the silver-containing exposed regions, resulting in thickness variations which can be seen under an electron microscope.

An electron photomicrograph of the patterned film at 5000× magnification is shown in the Drawing, the white bar in the photograph illustrating a dimension of 10 microns. Although the optical density of the image components is not shown, the photograph clearly shows the 1.25 micron line spacing of the original electron beam scanning pattern, and suggests that a line resolution of about 2000 Å is provided by this film under the writing conditions described. This parallel line pattern could be used to selectively mask a photoresist layer against exposure to visible or ultraviolet light, if desired.

The foregoing results may be directly contrasted with those observed when an undoped silver chloride film, consisting essentially of polycrystalline silver chloride in a thickness of about 1.4 microns and disposed on a glass slide substrate, is exposed to an electron beam for direct writing. Under beam writing conditions substantially the same as were employed in the above illustrative Example, and for the same exposure interval, no visually detectable darkening of the undoped silver chloride film was observed. This demonstrates the importance of composition on electron beam writing characteristics.

Of course, the foregoing Example is merely illustrative of methods by which electron beam-sensitive films may be produced and used to provide high resolution optical masks in accordance with the invention. Numerous variations and modifications of these illustrative procedures may be resorted within the scope of the appended claims.

We claim:

1. An electron beam recording medium comprising a supported polycrystalline film containing cadmium chloride-doped silver chloride in combination with tin oxide.

2. An electron beam recording medium comprising a supported polycrystalline film which consists essentially of AgCl, $CdCl_2$ and $SnO_x$, wherein x is between 1 and 2, the weight ratio $AgCl/CdCl_2$ is in the range of 4–24, and the weight ratio $AgCl/SnO_x$ is in the range of 5–60.

3. An electron beam recording medium in accordance with claim 2 wherein the polycrystalline film consists essentially of a mixture of AgCl, $CdCl_2$ and $SnO_x$.

4. An electron beam recording medium in accordance with claim 2 wherein the polycrystalline film consists essentially of alternating layers of $SnO_x$ and mixed AgCl–$CdCl_2$.

5. An electron beam recording medium in accordance with claim 2 wherein the polycrystalline film has a thickness in the range of about 0.1–2 microns.

6. A method for making an optical mask which comprises the step of selectively darkening portions of a polycrystalline film containing cadmium chloride-doped silver chloride in combination with tin oxide by exposing said portions to an electron beam for a time sufficient to obtain an optical contrast ratio of at least about 3 between the selectively darkened portions of the film and the undarkened portions thereof.

7. A method for making an optical mask which comprises the step of selectively darkening portions of a polycrystalline film by exposing said portions to an electron beam, said film consisting essentially of AgCl, $CdCl_2$ and $SnO_x$, wherein x is between 1 and 2, the weight ratio AgCl $CdCl_2$ is in the range 4–24, and the weight ratio $AgCl/SnO_x$ is in the range of about 5–60, said exposure being continued for a time sufficient to obtain an optical contrast ratio of at least about 3 between said darkened portions of said film and the undarkened portions thereof.

8. A method in accordance with claim 7 wherein the polycrystalline film consists essentially of a mixture of AgCl, $CdCl_2$ and $SnO_x$.

9. A method in accordance with claim 7 wherein the polycrystalline film consists essentially of alternating layers of $SnO_x$ and mixed AgCl—$CdCl_2$.

10. A method in accordance with claim 7 wherein the polycrystalline film has a thickness in the range of about 0.1–2 microns.

* * * * *